United States Patent [19]

Ueda et al.

[11] Patent Number: 4,587,696

[45] Date of Patent: May 13, 1986

[54] BUCKLE FOR SEAT BELT

[75] Inventors: Takeo Ueda, Fujisawa; Masaru Morinaga, Yamato, both of Japan

[73] Assignee: NSK Warner K. K., Tokyo, Japan

[21] Appl. No.: 552,694

[22] Filed: Nov. 17, 1983

[30] Foreign Application Priority Data

Nov. 30, 1982 [JP] Japan ..... 57-179876[U]

[51] Int. Cl.[4] ..... A44B 11/26

[52] U.S. Cl. ..... 24/637; 24/651; 200/61.58 B

[58] Field of Search ..... 24/574, 630–633, 24/636–638, 643, 644, 651; 297/468; 280/801; 200/61.58 B

[56] References Cited

U.S. PATENT DOCUMENTS

| | | | |
|---|---|---|---|
| 3,189,966 | 6/1965 | Craven | 24/637 |
| 3,425,103 | 2/1969 | Melin . | |
| 3,494,007 | 2/1970 | Dahms . | |
| 3,605,209 | 9/1971 | Alarcon | 24/637 |
| 3,708,838 | 1/1973 | Gonzalez | 24/637 |
| 4,000,385 | 12/1976 | Colasanti | 200/61.58 B |
| 4,377,888 | 3/1983 | Ikesue | 24/637 |
| 4,382,320 | 5/1983 | Yamamura | 24/633 |
| 4,391,024 | 7/1983 | Morinaga | 24/637 |
| 4,394,792 | 7/1983 | Schmidt | 24/637 |

FOREIGN PATENT DOCUMENTS

| | | | |
|---|---|---|---|
| 2648418 | 4/1978 | Fed. Rep. of Germany | 200/61.58 B |
| 1531823 | 11/1978 | United Kingdom | 24/637 |

*Primary Examiner*—William E. Lyddane
*Assistant Examiner*—James R. Brittain
*Attorney, Agent, or Firm*—Shapiro and Shapiro

[57] ABSTRACT

A buckle for a seat belt includes a latch piece pivotably supported by a buckle body and having a latch portion engageable with a tang when pivoted in a first direction, a release button pivotably supported by the buckle body and engageable with the latch piece during the pivotal movement thereof in the first direction to cause the latch piece to pivotally move in a second direction and release the engagement thereof with the tang, a first biasing member for biasing the latch piece in the first direction, and a second biasing member for biasing the release button in the second direction. The latch piece has its mid-portion as the center of pivotal movement, and the release button has one end thereof as the center of pivotable movement. The end of the latch piece opposite to the latch portion thereof is engageable with the vicinity of the center of rotation of the release button.

9 Claims, 5 Drawing Figures

BUCKLE FOR SEAT BELT

BACKGROUND OF THE INVENTION

1. Field of the Invention

This invention relates to improvements in a buckle for a seat belt used to restrain the seat occupant in a vehicle or the like.

2. Description of the Prior Art

The buckle comprises a buckle body to which webbing is connected and a tang inserted in and engaged with the buckle body. Generally, the tang is inserted into the buckle body after the seat occupant has taken his seat, and is held in engagement with the buckle body by a latch piece, and the engagement of the tang by the latch piece is released by a release button being depressed prior to the alighting of the seat occupant from the vehicle, and then the tang is removed from the buckle body.

In this case, it is necessary that the release button and the latch piece be biased in predetermined directions by various springs, but heretofore, it has often been the case that discrete springs are disposed to bias the release button and the latch piece in the same direction at the same time. Also, there has been a disadvantage that when the restraint of the tang by the latch piece is to be released by means of the release button, the force depressing the button sharply increases as the button is depressed and this leads to an unpleasant feeling.

SUMMARY OF THE INVENTION

It is an object of the present invention to provide a buckle for a seat belt which can eliminate the above-noted disadvantage peculiar to the prior art, that is, a buckle for a seat belt in which the feeling during depression of the release button is constant.

It is a further object of the present invention to provide a buckle for a seat belt which is relatively simple and compact in structure.

The invention will become fully apparent from the following detailed description of an embodiment thereof taken in conjunction with the accompanying drawings.

DESCRIPTION OF THE PREFERRED EMBODIMENT

Figure 1:
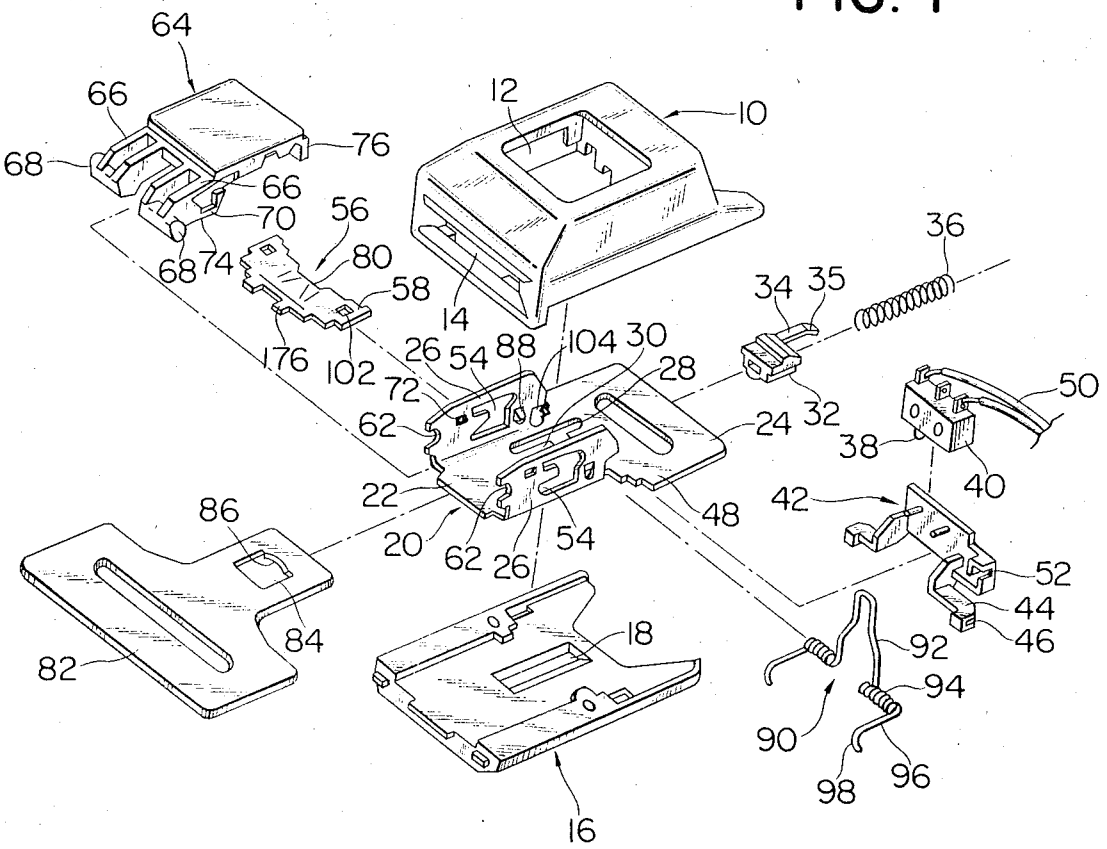
FIGS. 1 to 5 show a preferred embodiment of the present invention, FIG. 1 being an exploded perspective view, FIG. 2 being a plan view (of only one half of the device), FIG. 3 being a cross-sectional view in the latched condition, FIG. 4 being a cross-sectional view in the non-latched condition, and FIG. 5 being a cross-sectional view in the released condition.
Figure 2:
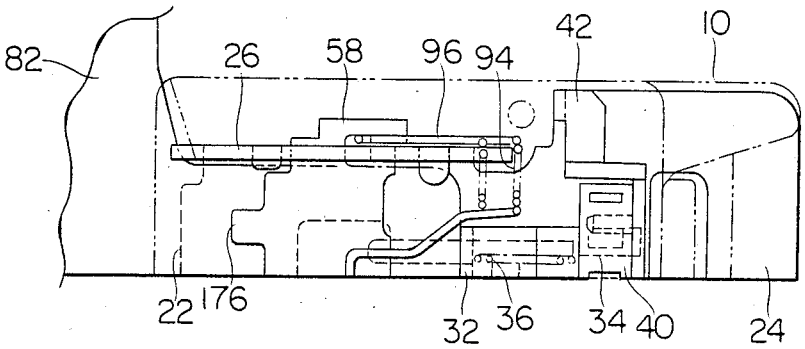
Figure 3:
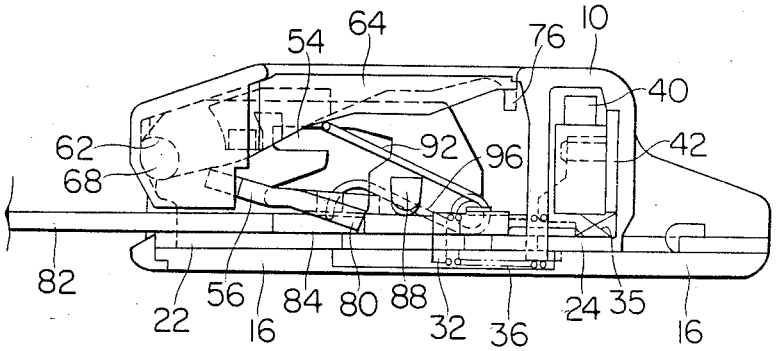

As shown in FIGS. 1 to 3, a buckle for a seat belt comprises a base 20, a release button 64, a tang 82 and a latch piece 56 all incorporated in a space defined by an upper cover 10 and a lower cover 16. The upper cover 10 is generally of a container-like shape, and an opening 12 for exposing the release button 64 therethrough is formed in the upper wall of the upper cover 10 and an insertion hole 14 for forcing the tang 82 thereinto is formed in the forward (left as viewed in FIG. 3) side wall of the upper cover 10. The lower cover 16 has a recess 18 for containing therein a spring 36 for biasing the tang 82 and is made integral with the upper cover 10 by screws or the like, not shown.

The base 20 comprises a narrow portion 22, a wide portion 24 and a pair of side wall portions 26 upwardly extending from the opposite sides of the narrow portion 22. The narrow portion 22 is formed with an H-shaped hole 28 and a slider 32 is inserted on a protruded portion 30 provided by the H-shape. The slider 32 has a resiliently deformable extension 34 formed of a synthetic resin material, is made movable along the protruded portion 30 in the center of the base 20 and is biased in one direction (the leftward direction as viewed in FIG. 3) by the spring 36 contained in the recess 18. The extension 34 serves to actuate a contact 38 of a switch 40 by the tapered surface 35 thereof. The switch 40 is held by a switch holder 42 which is fixed to the base 20 by the insertion portion 48 of the wide portion 24 being inserted into grooves 46 formed in a pair of arm portions 44. A harness 50 of the switch 40 may be drawn out through a hollow portion 52 of the holder 42.

The opposite side portions 58 of the latch piece 56 are pivotably inserted in pivot holes 54 formed in the side wall portions 26 and protrusions 68 formed at the end portion of the arms 66 of the release button 64 are fitted in semicircular cut-aways 62, and the release button 64 may be pivoted about the protrusions 68. Each arm 66 of the release button 64 has a portion that can bear against an inwardly projecting portion 72 of the base 20 at an upwardly facing surface 70 and that can bear against a projection 176 of the latch piece 56 at a lower surface 74 see FIG. 1. The release button 64 has a side edge that prevents the release button from slipping upward through the opening 12 of the upper cover 10 at the region of the side edge 76. The latch piece 56 has a downwardly bulged latch portion 80 in the midportion thereof, and this latch portion 80 is engageable with the latch surface 86 of the latch hole 84 of the tang 82. A stop 88 for preventing the floating up of the tang 82 is formed on each side wall portion 26 of the base 20.

A torsion coil spring 90 comprises a body portion 92, a pair of coil spring portions 94 and a pair of leg portions 96 and in their natural condition, the body portion 92 and leg portions 96 generally form right angles with each other. This torsion coil spring 90 has the distal ends 98 of its leg portions 96 inserted in the holes 102 of the latch piece 56, its spring portions 94 fitted in the cut-outs 104 of the side wall portions 26, and its body portion 92 brought into contact with the lower surface of the release button 64.

Operation of the present embodiment will now be described.

Figure 4:
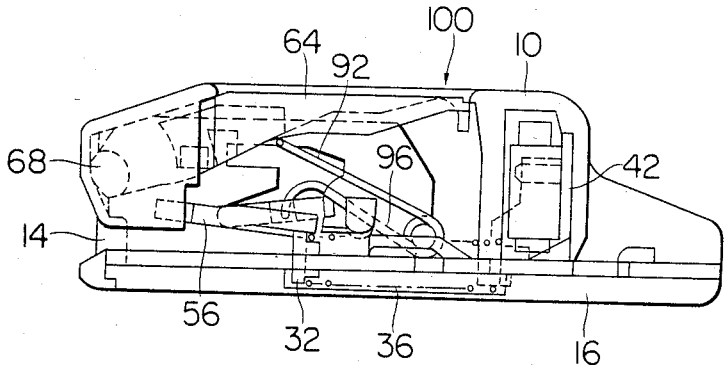

What is shown in FIG. 3 is the condition during latching, and what is shown in FIG. 4 is the condition during non-latching. That is, the biasing force of the torsion coil spring 90 is transmitted to the release button 64 through the body portion 92 and the release button 64 is in its leftwardly turned condition. The biasing force of the torsion coil spring 90 is also transmitted to the latch piece 56 through the leg portions 96, but in the condition of FIG. 4, the slider 32 is moved leftwardly by the biasing force of the compression coil spring 36 and slips under the latch portion 80 of the latch piece 56 to thereby prevent rightward turning thereof. Thus, the latch piece 56 does not hamper the insertion of the tang 82.

When the tang 82 is subsequently inserted rightwardly through the tang insertion hole 14, the fore end portion thereof bears against the slider 32, whereafter as the tang 82 is inserted, the slider 32 moves rightwardly while compressing the spring 36. At this time, the latch portion 80 of the latch piece 56 is brought out of contact with the slider 32 and is in contact with the upper surface of the tang 82. Accordingly, when the tang 82 is inserted into a predetermined position as shown in FIG. 3, the latch piece 56 is further turned rightwardly by the biasing force of the spring 90 and the latch portion 80 is fitted into the latch hole 84 and comes into engagement with the latch surface 86. Simultaneously therewith, the tapered surface 35 of the slider 32 pushes up the contact 38 to close the switch 40, thus indicating that the tang 82 has been completely mounted on the buckle 100. In the present embodiment, the slider 32 and the switch 40 are disposed in substantially vertically overlapping condition (the switch 40 is made upright) and therefore, the buckle body 100 need not be elongated in lateral direction (the direction of insertion of the tang 82). Also, the extension 34 is resilient and this ensures reliable operation of the switch 40.

With the tang 82 mounted to the buckle body 100, the webbing (not shown) connected to the tang 82 and the base 20 restrains the seat occupant.

Figure 5:
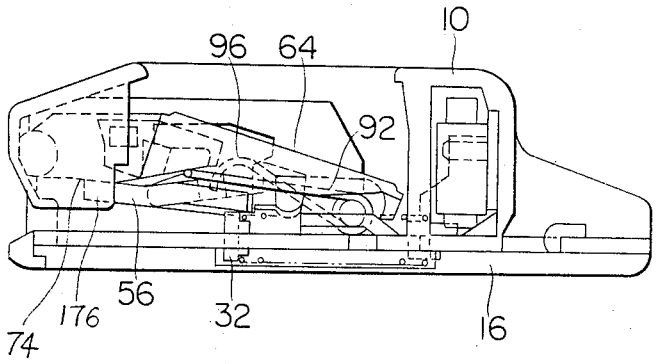

To detach the tang 82 from the buckle body 100, the release button 64 may be depressed downwardly as shown in FIG. 5. Thereupon, the release button 64 is turned rightwardly about the protrusions 68 against the biasing force of the spring 90 and bears against the projection 176 at the lower surface 74 thereof to thereby turn the latch piece 56 in the pivot holes 54. As a result, the engagement between the latch portion 80 of the latch piece and the latch surface 86 of the tang is released and thus, the tang 82 becomes capable of being drawn out. Even after the tang 82 has been drawn out, the latch piece 56 remains in its leftwardly turned condition as long as the button 64 is depressed, and the slider 32 is brought under the latch portion 80 by the biasing force of the spring 36, whereby the condition shown in FIG. 4 is restored.

Here, there will be described the advantages of the double torsion type coil spring 90. The release button 64 and the latch piece 56 are biased at the same time by a single spring and therefore, as compared with a case where they are biased by discrete springs, the number of parts is reduced and the entire device becomes compact. Also, if attention is given to the width and length of the spring portion 94, the magnitude of the biasing force imparted to the release button 64 and the latch piece 56 can be made substantially constant irrespective of their rotated condition. This will enhance the operability of the release button 64 and will ensure the engagement and disengagement between the latch piece and the tang 82.

Also, the center of pivotal movement of the latch piece 56 is selected to be at the mid-portion thereof, and a projection 176 serving as a release force acting portion is formed at one end the latch piece and a latch portion 80 is formed at the other end of the latch piece, and the projection 176 is positioned near the protrusions 68 which are the center of pivotal movement of the release button 64, and it is the free end of the release button on which a force is exerted by the hand. Thus, a great lever ratio can be secured and the latch piece 56 may be pivoted only by applying a small pressure force to the free end of the button 64 so that the restraint of the tang 82 may be easily released.

What has been described above is merely an embodiment of the present invention and the present invention is not restricted thereto. For example, the positional relation between the slider 32 and the switch 40 is not restricted to that in the above-described embodiment. However, as previously described, adopting the positional relation as in the above-described embodiment is effective.

According to the present invention, as has hitherto been described, there is provided a buckle for a seat belt in which the feeling during depression of the release button is stable and which is simple and compact in structure.

We claim:

1. A buckle for a seat belt including a latch piece pivotably connected to a buckle body, said latch piece having its mid-portion as the center of pivotal movement and having a latch portion at one end engageable with a tang when pivoted in a first direction and a release portion at an opposite end, a release button pivotably connected to said buckle body and having one end thereof as the center of pivotal movement, the release portion of the latch piece being positioned between the center of pivotal movement of the latch piece and the center of pivotal movement of the release button, said center of pivotal movement of said release button being close to said release portion of said latch piece and remote from said latch portion of said latch piece, said release button being positioned relative to said latch piece so as to be engageable with said release portion of said latch piece in the vicinity of said one end of said release button during pivotal movement thereof in the first direction to cause the latch piece to pivotally move in a second direction opposite to the first direction and release the engagement thereof with said tang, and biasing means for biasing said latch piece in the first direction and biasing said release button in the second direction.

2. A buckle as claimed in claim 1, wherein said biasing means is provided by a single biasing member.

3. A buckle as claimed in claim 2, wherein said biasing member is a torsion coil spring comprising a pair of coil spring portions, a body portion between said coil spring portions and a pair of leg portions extending from outer ends of said coil spring portions, said body portion engaging said release button to bias said release button in the second direction and said leg portions engaging said latch piece to bias said latch piece in the second direction.

4. A buckle as claimed in claim 1, further comprising a slider slidably connected to said buckle body, said slider ejecting said tang when said tang is disengaged from said latch piece and said slider slips under said latch piece to prevent said latch piece from further turning in the first direction.

5. A buckle as claimed in claim 4, wherein said slider has a resiliently deformable extension for actuating a contact of a switch to detect the engagement of said tang with said latch piece.

6. A buckle as claimed in claim 4, further comprising a switch for detecting the engagement of said tang with said latch piece, said switch having a contact movable along a direction substantially perpendicular to the sliding direction of said slider and wherein said slider includes means for converting the movement of said slider in the sliding direction to the movement of said contact in the direction substantially perpendicular to the sliding direction, said converting means lying under said contact during the engagement of said tang with said latch piece.

7. A buckle as claimed in claim 6, wherein said converting means comprises an extension extending integrally with said slider, said extension having a tapered surface with respect to the sliding direction of said slider.

8. A buckle as claimed in claim 7, wherein said extension is mounted to the side of said slider opposite to the side thereof at which said slider abuts said tang, with respect to the sliding direction of said slider.

9. A buckle as claimed in claim 6, wherein said converting means comprises a resiliently deformable member.

* * * * *